US007896679B2

(12) United States Patent
Hsu et al.

(10) Patent No.: US 7,896,679 B2
(45) Date of Patent: Mar. 1, 2011

(54) ELECTRICAL CONNECTOR HAVING LID OPERATING AS ACTUATOR

(75) Inventors: Hsiu-Yuan Hsu, Tu-Cheng (TW); Chun-Fu Lin, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/547,503

(22) Filed: Aug. 26, 2009

(65) Prior Publication Data

US 2010/0055960 A1 Mar. 4, 2010

(30) Foreign Application Priority Data

Aug. 26, 2008 (TW) ..... 97215280 U

(51) Int. Cl.
*H01R 4/50* (2006.01)

(52) U.S. Cl. ..... 439/342; 439/331

(58) Field of Classification Search ..... 439/342, 439/73, 331
See application file for complete search history.

(56) References Cited

U.S. PATENT DOCUMENTS 6,315,592 B1 11/2001 Keller et al.
6,821,138 B2 * 11/2004 Hou ..... 439/342
7,021,954 B2 * 4/2006 Gattuso et al. ..... 439/342
7,161,805 B2 * 1/2007 Gattuso et al. ..... 361/704

* cited by examiner

*Primary Examiner*—Gary F. Paumen
(74) *Attorney, Agent, or Firm*—Andrew C. Cheng; Wei Te Chung; Ming Chieh Chang

(57) ABSTRACT

An electrical connector comprises a base having a plurality of passageways for receiving a number of contacts, a cover mounted to the base and including a plurality of through holes corresponding to the passageways, and a lid having two opposite edges. One edge is mounted upon the cover to drive the cover to move relative to the base, and the other edge locks the base when the lid is located at a close position relative to the base.

20 Claims, 5 Drawing Sheets

ELECTRICAL CONNECTOR HAVING LID OPERATING AS ACTUATOR

BACKGROUND OF THE INVENTION

1. Field of the Invention

The present invention relates to an electrical connector, and more particularly to an electrical connector having a lid to drive a cover mounted onto a base.

2. Description of the Prior Art

Various types of conventional electrical connectors used for attaching electronic packages are well known. Each of the electronic packages has a large number of contacts that are arranged in a matrix-like array. The electronic packages are classified as Pin Grid Array (PAG) packages, Ball Grid Array (BAG) packages, or Land Grid Array (LAG) packages in view of a pin leg or a conductive pad of the electronic package.

The electrical connector used for electrically connecting the PGA package is also referred as zero-insertion-force (ZIF) socket in view of its operational mechanism and can refer to U.S. Pat. No. 6,821,138 issued to Hou on Nov. 23, 2004. The ZIF socket typically comprises a base having a plurality of terminals, a cover moveably mounted on the base, and an actuator driving the cover to move relative to the base between a first and a second positions. The cover has a plurality of through holes to receive the pin legs of the PGA package. The actuator generally includes a cam with a plurality of posts offset from a central axis or an L-shaped lever. The lever is made of metallic rod and comprises a retaining portion mounted between the cover and the base and an operating portion perpendicular to the retaining portion for being handed by an operator. When the lever is rotated counterclockwise to a substantially vertical position, the cover is located at a first position in which the pin legs of the electronic package can easily passing through the through holes of the cover, and then reaches into a passageway of the base; when the lever is rotated clockwise to a substantially horizontal direction, the cover is driven toward a second position and during which, the cover on which the electronic package is carried is moved in accordance with the cover. The movement of the cover will drive the pin leg to contact with the terminal within the base therefore establishing an electrical interconnection therebetween. In using, the ZIF socket and the PGA package generate a great deal of heat that may malfunction the PGA package, so that a heat sink is needed to dissipate the heat built-up thereof. However, the heat sink for the electrical connector is generally assembled with the ZIF socket difficult to detach.

Therefore, it is need to find a new electrical connector to overcome the problems mentioned above.

SUMMARY OF THE INVENTION

Accordingly, an object of the present invention is to provide an electrical connector with a lid for driving a cover move relative to a base.

In order to achieve the object set forth, an electrical connector comprises a base having a plurality of passageways for receiving contacts, a cover mounted on the base and including a plurality of through holes corresponding to the passageways, and a lid having a first and a second edges. The first edge drives the cover horizontally to move relative to the base during a rotation of the lid, and the second edge locks the base when the lid is located at a close position relative to the base.

In order to further achieve the object set forth, an electrical connector, comprises a base having a plurality of passageways for receiving contacts, a cover mounted to the base and including a plurality of through holes corresponding to the passageways, and a lid having a first edge and a second edge opposite to the first edge. The first edge comprises a lever with an eccentric portion driving the cover move relative to the base.

DESCRIPTION OF PREFERRED EMBODIMENT

Reference will now be made to the drawings to describe the present invention in detail.

Figure 1:
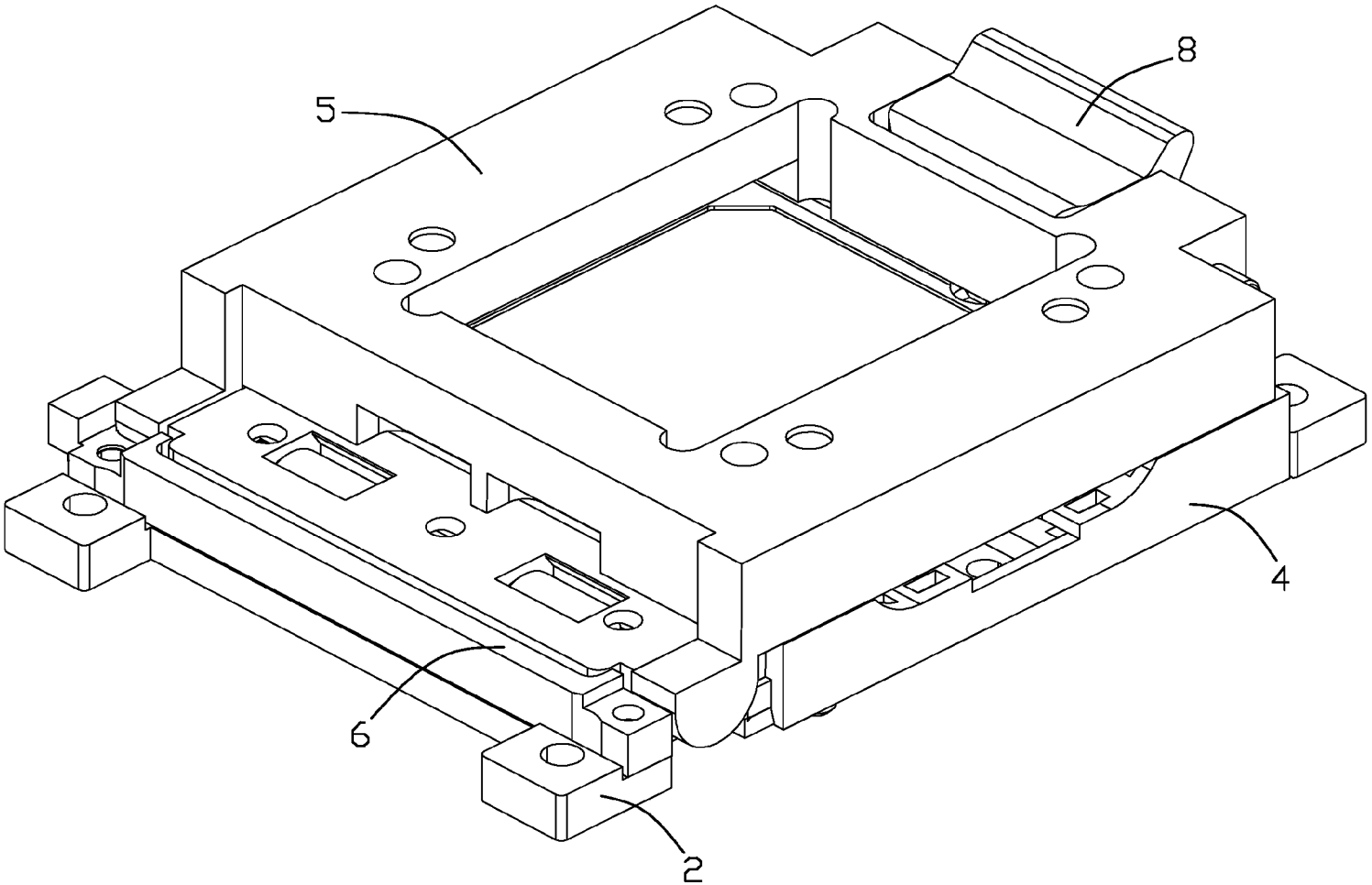
FIG. 1 is an assembled, perspective view of an electrical connector of the present invention showing a lid of the electrical connector located at a close position.
Figure 2:
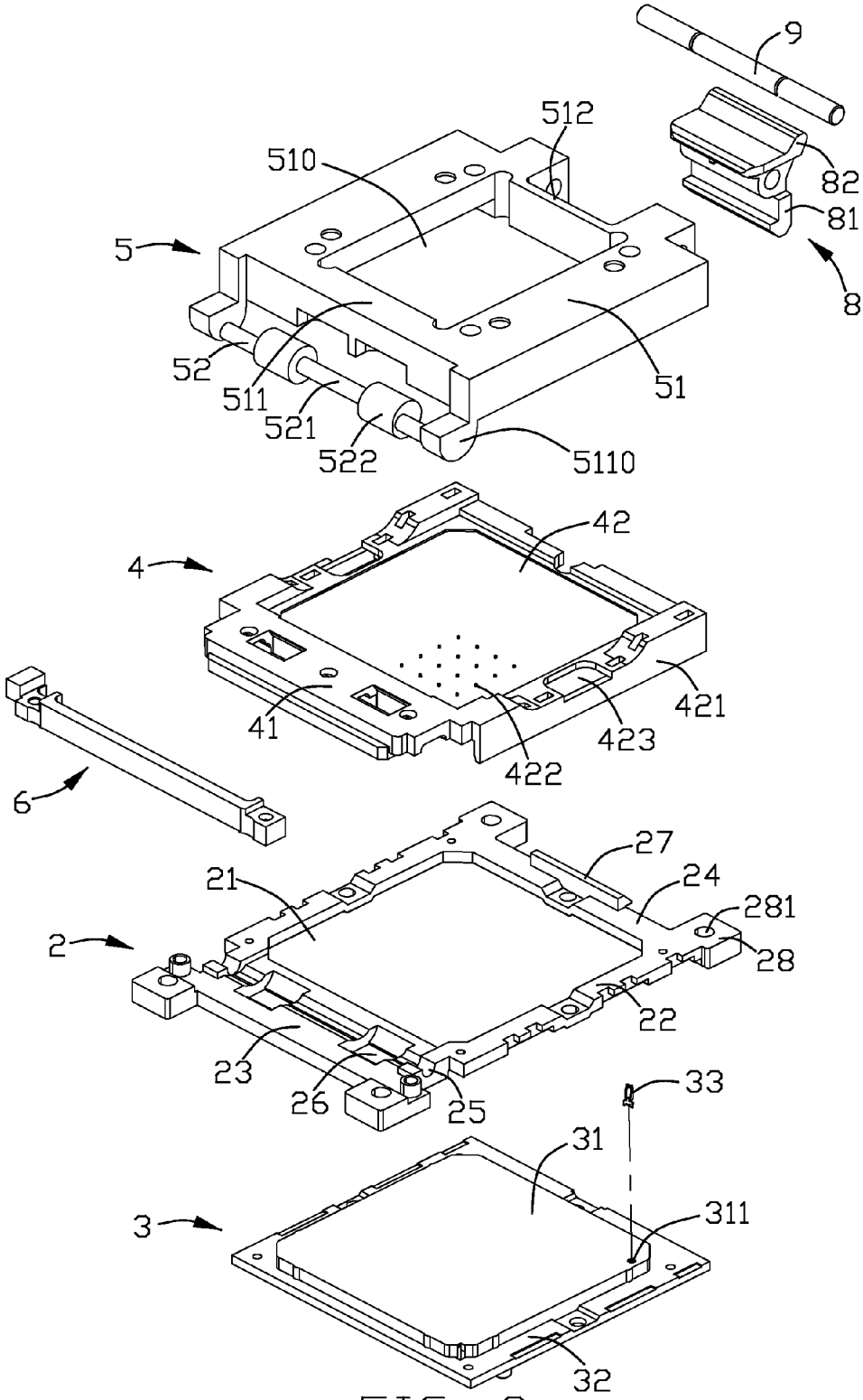
FIG. 2 is an exploded, perspective view of the electrical connector of FIG. 1.

Referring to FIG. 1 to FIG. 2, an electrical connector used to electrically connect a first electrical component, such as an electronic package (not shown), and a second electrical component, such as a printed circuit board (not shown) is shown. The electrical connector comprises a base, a cover 4 mounted on the base, and a lid 5 driving the cover 4 to move relative to the base. The base includes a frame 2 and an insulative housing 3 mounted to the frame 2. A plurality of contacts 33 are retained in the insulative housing 3.

The frame 2 is formed with a substantially rectangular configuration and defines an opening 21 in a center thereof. The frame 2 is further formed with a pair of opposite side walls 22, a first end 23 and a second end 24 located at opposite sides and connecting the side walls 22. The first end 23 is used for pivotally linking with the lid 5. A stiffener 6 is mounted on the first end 23 by screws (not shown) to press a corresponding end of the cover 4 for preventing the cover 4 from deformation. An engaging portion 27 protrudes from a middle of the second end 24. The frame 2 has four securing portions 28 extending from four corners thereof. Each securing portion 28 defines a hole 281 for a screw passing therethrough to secure the frame 2 on the printed circuit board (not shown).

The insulative housing 3 is molded by an insulative synthetic resin. The insulative housing 3 includes a planar base 32 and a platform 31 embossed from a middle of the planar base 32. A plurality of passageways 311 (only one is shown in FIG. 2) are defined on the platform 31 for receiving the contacts 33 to establish an electrical connection between the electronic package (not shown) and the printed circuit board (not shown). The planar base 31 is fastened on the printed circuit board (not shown) by a plurality of screws (not shown), and the platform 31 extends through the opening 21.

The cover 4 is mounted to the frame 2 and comprises a head portion 41 and a main portion 42 connected with the head portion 41. A receiving recess 25 is formed between the head portion 41 and the first end 23 of the frame 2, and two concaves 26 transversely lie thereof and extend through the cover 4. The main portion 42 has two opposite sidewalls 421 extending downwardly thereof for engaging with the sidewalls 22 of the frame 2. A plurality of through holes 422 are defined in the main portion 42 corresponding to the passageways 311 of the insulative housing 3 for leading pins (not shown) of the electronic package (not shown) into the passageways 311 of the insulative housing 3. A pair of notches 423 are formed on the main portion 42 and adjacent to the sidewalls 421 for easily assembling or disassembling the electronic package (not shown) from the electrical connector.

Figure 3:
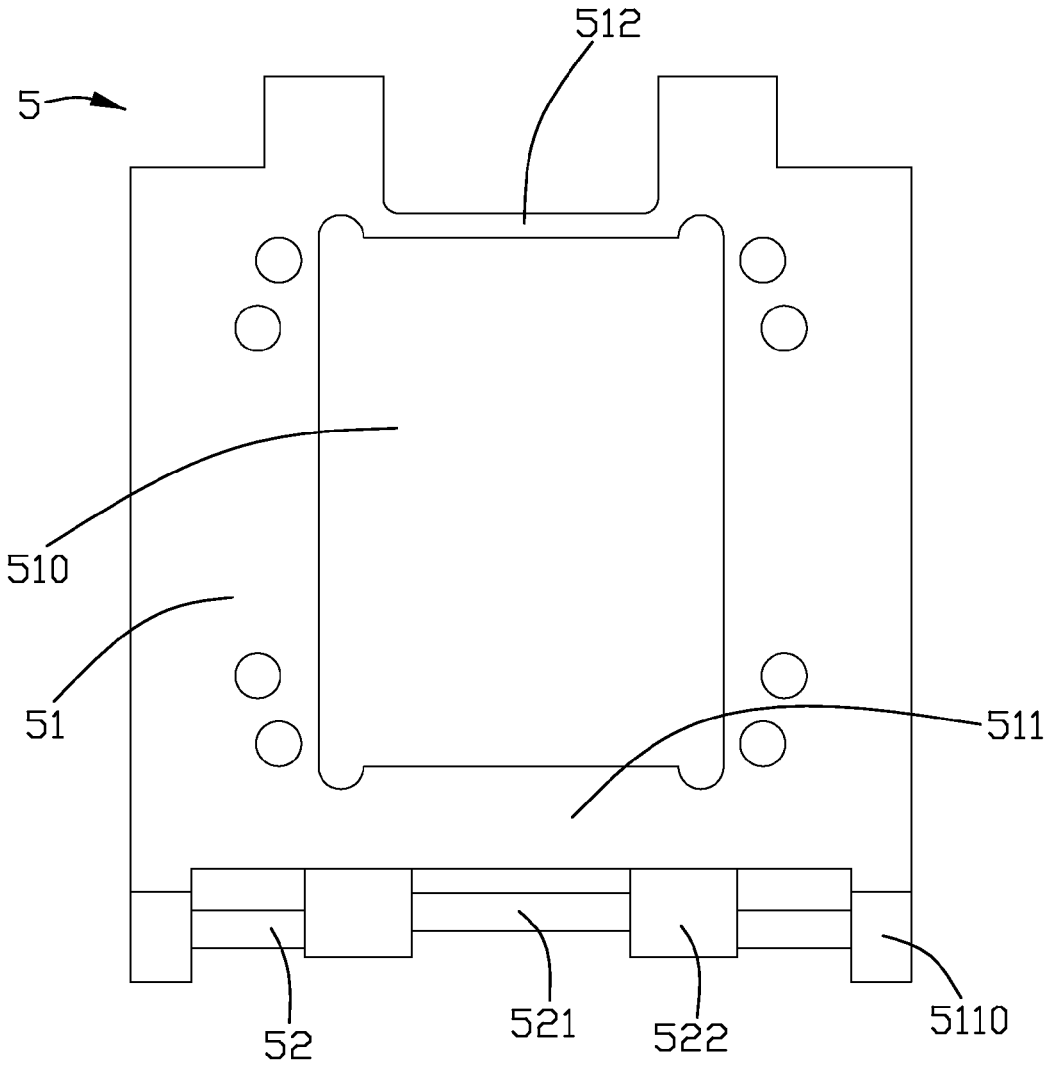
FIG. 3 is a top view of the lid of the electrical connector.

Referring to FIG. 2 and FIG. 3, the lid 5 is pivotally mounted upon the cover 4 and includes a substantially rectangular main body 51 and a lever 52 disposed at an end of the main body 51. The main body 51 has an opening 510 in a center thereof for receiving other electrical element, such as a heat sink 7. The frame 51 defines a first edge 511 and a second edge 512 corresponding to the first end 23 and the second end 24 of the frame 2, respectively. A pair of connecting portions 5110 are disposed at a bottom of the first edge 511 for assembling the lever 52. The connecting portion 5110 is formed with a semicircular cross-sectional shape for reducing friction with respect to with the frame 2 and the stiffener 6, respectively. The lever 52 is disposed between the connecting portions 5110 and includes an eccentric axis 521 disposed at a center thereof which offsets toward the main body 51. The eccentric axis 521 has two cams 522 coaxial with the eccentric axis 521 and eccentrically with the lever 52 besides the eccentric axis 521. The lever 52 and the cams 522 are received in the receiving recess 25 and the concaves 26, respectively. Alternatively, the lever 52 also can be a straight rod with an eccentric cam. The cams 522 can drive the cover 4 to move relative to the insulative housing 3. The lever 52 can be integrally formed with the main body 51 and also can be individually formed with the main body 51. A clasp 8 is assembled to the second edge 512 of the main body 51 by a rod 9. The clasp 8 includes a hook 81 extending downwardly for engaging with the engaging portion 27 of the frame 2 and a handle portion 82 extending upwardly from the hook 81 for being operated.

Figure 4:
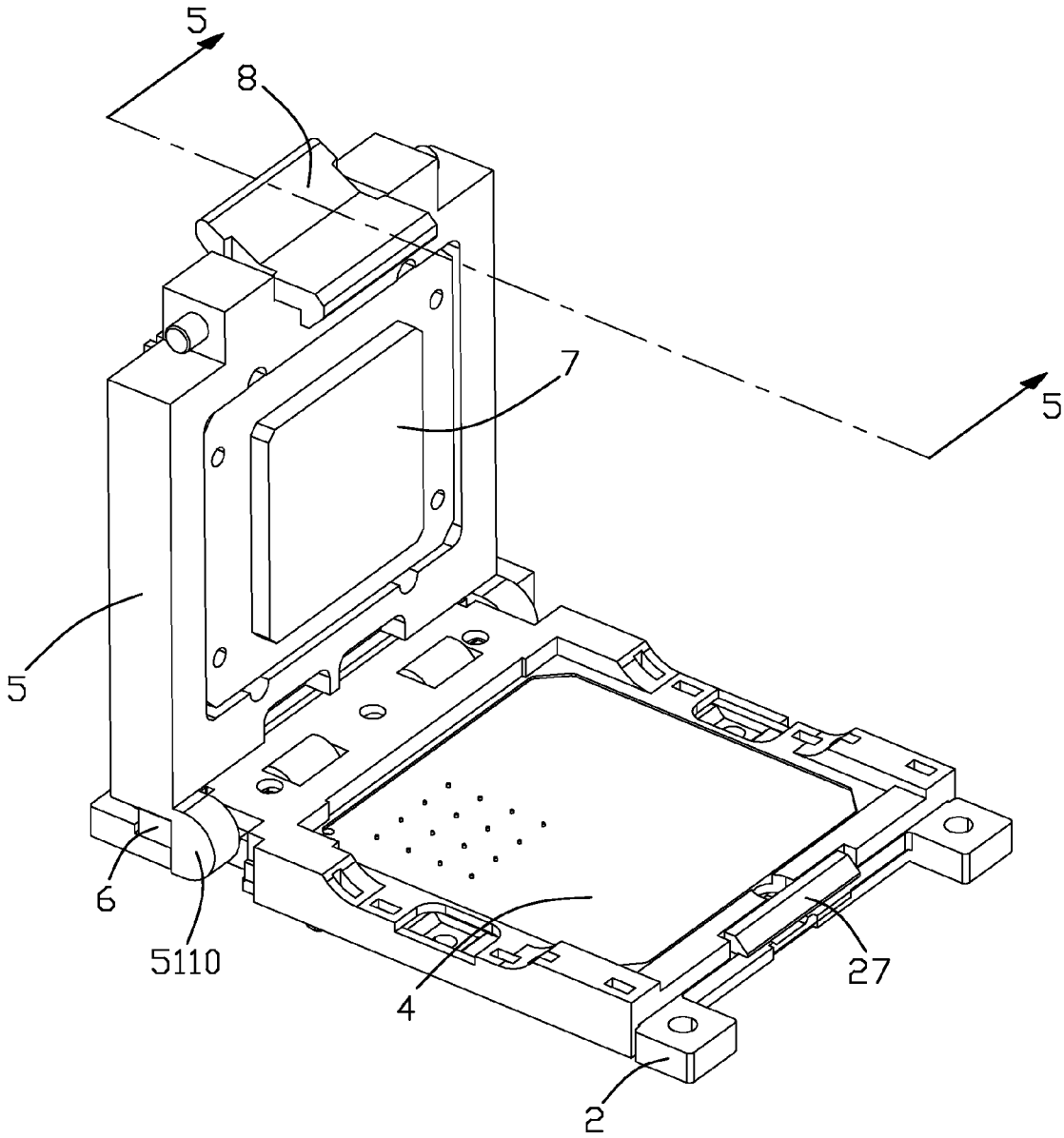
FIG. 4 is another assembled, perspective view of the electrical connector with a heat sink mounted on the lid, wherein the lid is at an open position.

FIG. 4 shows a heat sink 7 assembled to the opening 510 of the lid 5. The heat sink 7 is mounted to the main body 51 by a plurality of connecting elements (not shown) passing through the opening 510 for abutting against the electronic package (not shown) to transmit heat thereof.

Figure 5:
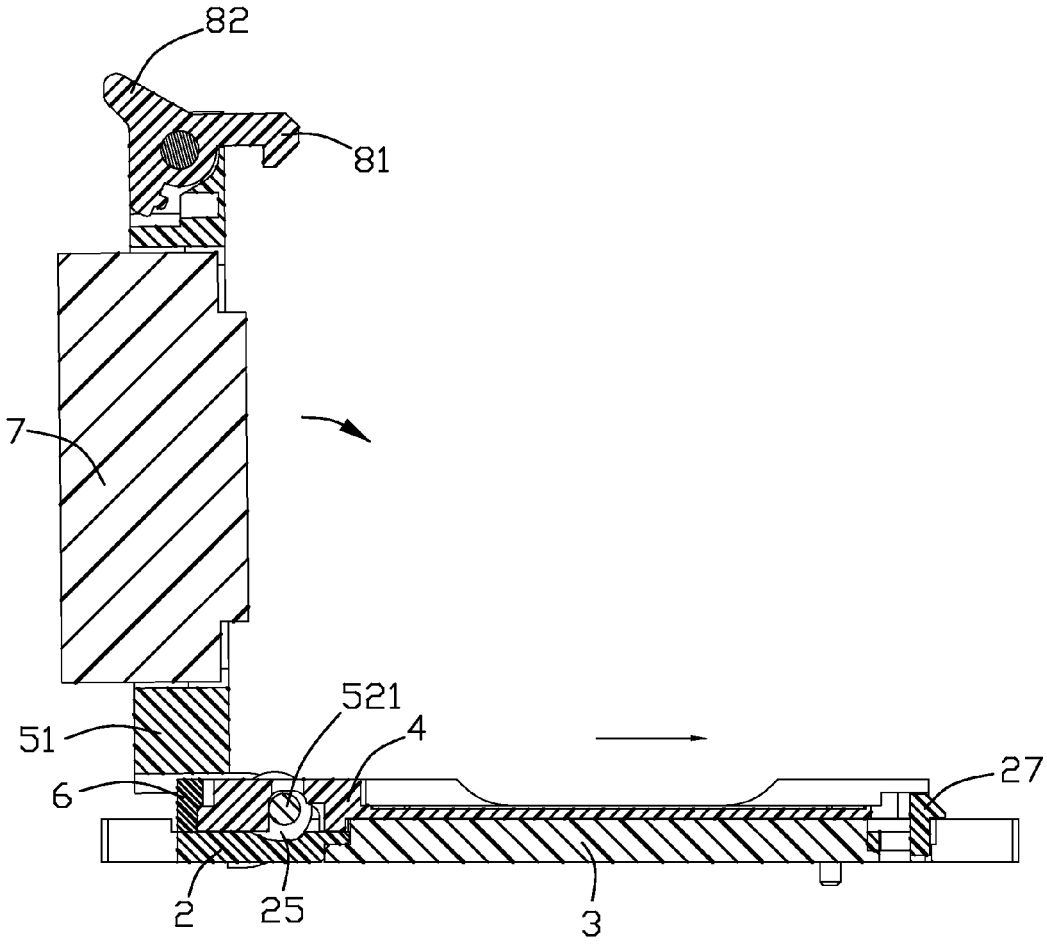
FIG. 5 is a cross-sectional view taken along line 5-5 of FIG. 4.

Referring to FIG. 5, when using the electrical connector, firstly, opening the lid 5 to a vertical direction; secondly loading the electronic package (not shown) upon the cover 4; thirdly, closing the lid 5 to a horizontal direction, during this process, the cams 522 drive the cover 4 to move in the horizontal direction as marked by the arrow for establishing a stably electrical connection between the pins of the electronic package (not shown) and the contacts 33 of the insulative housing 3; and lastly, the hook 51 engages with the engaging portion 27 to fasten the lid 5 and the base. The working principle of the lid 5 to drive the cover 4 to move relative to the insulative housing 3 is same with the conventional pin grid array (PAG) connector, so that no detailed description is given herein, and pertinent description can be referred to U.S. Pat. No. 6,315,592 issued to Keller et. al on Nov. 13, 2001.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

a base having a plurality of passageways for receiving contacts;

a cover mounted on the base and including a plurality of through holes corresponding to the passageways; and a lid having a first edge driving the cover to move horizontally relative to the base during a rotation of the lid, and a second edge locking the base when the lid is located at a closed position relative to the base.

2. The electrical connector as claimed in claim 1, wherein the lid has a lever rotationally mounted at the first edge thereof.

3. The electrical connector as claimed in claim 2, wherein the lever includes an eccentric axis in a middle thereof and a cam disposed on the eccentric axis and being coaxial with the eccentric axis.

4. The electrical connector as claimed in claim 3, wherein a pair of connecting portions are formed on the first edge, and the lever is assembled between the two connecting portions.

5. The electrical connector as claimed in claim 4, wherein each connecting portion has a semicircular cross-sectional shape for reducing friction.

6. The electrical connector as claimed in claim 1, wherein a clasp is assembled to the second edge of the lid, an engaging portion protrudes from the base, and the clasp locks the engaging portion when the lid is at the close position.

7. The electrical connector as claimed in claim 1, wherein the lid has an opening at a center thereof.

8. An electrical connector, comprising:

a base having a plurality of passageways for receiving contacts;

a cover mounted to the base and including a plurality of through holes corresponding to the passageways; and a lid having a first edge and a second edge opposite to the first edge, the first edge comprising a lever with an eccentric portion, the eccentric portion defining an axis line parallel to an axis line of the lever, the eccentric portion having at least one cam to drive the cover to move relative to the base.

9. The electrical connector as claimed in claim 8, wherein the eccentric portion includes an eccentric axis, the cam is coaxial with the eccentric axis.

10. The electrical connector as claimed in claim 9, wherein the lever is integrally formed with the lid.

11. The electrical connector as claimed in claim 10, wherein the base includes a frame with an opening in a middle thereof and an insulative housing mounted to the frame.

12. The electrical connector as claimed in claim 11, wherein the insulative housing includes a planar base engaging with a bottom surface of the frame and fastened by screws, and a platform protruding from a middle of the planar base and extending through the opening of the frame.

13. The electrical connector as claimed in claim 12, wherein the passageways are defined on the platform of the insulative housing.

14. The electrical connector as claimed in claim 13, wherein a receiving recess is formed between the cover and the frame, and a concave transversely lies and extends through the cover for receiving the cam.

15. The electrical connector as claimed in claim 14, wherein a stiffener is mounted on the base and presses the first edge of the cover for preventing the cover from deformation.

16. The electrical connector as claimed in claim 8, wherein a clasp is assembled to the second edge of the lid, and an engaging portion protrudes from the base, the clasp locks the engaging portion when the lid is at a close position.

17. The electrical connector as claimed in claim 8, wherein said lid is equipped with a heat dissipation device and defining a confinement room in which an electronic package is received under condition that said electronic package is moved along with the cover in a front-to-back direction and sandwiched between the cover and the heat dissipation device in a vertical direction perpendicular to said front-to-back direction.

18. An electrical connector, comprising:

a base having a plurality of passageways;

a lid mounted upon the base and rotatable relative to the base, the lid defining an axis along which the lid rotates, a cam disposed on the lid with an offset from the axis; and a cover sandwiched between the base and lid and including a plurality of through holes corresponding to the passageways of the base, the cover driven by the cam horizontally move relative to the base during a downward rotation of the lid relative to the base.

19. The electrical connector as claimed in claim 18, wherein the lid includes a main body located upon the cover and a lever with the cam located between the cover and the base.

20. The electrical connector as claimed in claim 19, wherein an eccentric axis is disposed at a center of the lever and offsets toward the main body, and the cam is located on the eccentric axis and coaxial with the eccentric axis.

* * * * *